US012063954B2

(12) United States Patent
Jarriault et al.

(10) Patent No.: US 12,063,954 B2
(45) Date of Patent: Aug. 20, 2024

(54) METHOD FOR THE PREPARATION OF A SHEET INCLUDING A HOMOGENIZED MATERIAL CONTAINING ALKALOIDS AND AEROSOL FORMING ARTICLE COMPRISING A COMPONENT PREPARED FROM IT

(71) Applicant: PHILIP MORRIS PRODUCTS S.A., Neuchatel (CH)

(72) Inventors: Marine Jarriault, Neuchatel (CH); Celine Lesuffleur, Neuchatel (CH); Alain Sciboz, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 873 days.

(21) Appl. No.: 16/956,789

(22) PCT Filed: Dec. 12, 2018

(86) PCT No.: PCT/EP2018/084644
§ 371 (c)(1),
(2) Date: Jun. 22, 2020

(87) PCT Pub. No.: WO2019/129493
PCT Pub. Date: Jul. 4, 2019

(65) Prior Publication Data

US 2020/0315240 A1 Oct. 8, 2020

(30) Foreign Application Priority Data

Dec. 29, 2017 (EP) ..... 17211109

(51) Int. Cl.
*A24B 15/14* (2006.01)
*A24B 3/14* (2006.01)
(Continued)

(52) U.S. Cl.
CPC ..... *A24B 3/14* (2013.01); *A24B 15/14* (2013.01); *A24B 15/167* (2016.11)

(58) Field of Classification Search
CPC ..... A24B 3/14; A24B 15/14; A24B 15/167
See application file for complete search history.

(56) References Cited

U.S. PATENT DOCUMENTS 3,098,492 A * 7/1963 Wurzburg ..... A24B 3/14 131/375
4,823,817 A * 4/1989 Luke ..... A24B 3/14 131/375

(Continued)

FOREIGN PATENT DOCUMENTS

CN 106714588 5/2017
CN 106714590 5/2017

(Continued)

OTHER PUBLICATIONS

Office Action issued in China for Application No. 201880084640.1 dated Dec. 29, 2021 (21 pages). English translation included.

(Continued)

*Primary Examiner* — Christopher M Rodd
*Assistant Examiner* — Jennifer A Kessie
(74) *Attorney, Agent, or Firm* — Mueting Raasch Group

(57) ABSTRACT

The invention relates to a method for the preparation of a sheet including a homogenized material containing alkaloids, said method comprising: —forming a mixture comprising particles of a material containing alkaloids and a starch component, and a quantity of a first additive comprising a component selected from the group consisting of water, aerosol-former and binder, wherein the quantity of the first additive is comprised between about 0.1 percent and about 50 percent by weight of the total weight of the mixture; —applying to the mixture a mechanical energy of at least about 20 watt-hour per kilogram of the mixture;

(Continued)

—combining the mixture with a quantity of a second additive comprising a component selected from the group consisting of water, aerosol-former, and binder, to form a slurry; and —forming a sheet from the slurry.

15 Claims, 2 Drawing Sheets

(51) Int. Cl.
*A24B 15/167* (2020.01)
*A24F 42/10* (2020.01)

(56) References Cited

U.S. PATENT DOCUMENTS

| | | | |
|---|---|---|---|
| 5,551,450 | A | 9/1996 | Hemsley |
| 10,321,707 | B2 | 6/2019 | Klipfel |
| 10,412,989 | B2 | 9/2019 | Klipfel |
| 10,813,381 | B2 | 10/2020 | Klipfel |
| 2017/0273348 | A1 | 9/2017 | Klipfel |

FOREIGN PATENT DOCUMENTS

| | | |
|---|---|---|
| CN | 107319628 | 11/2017 |
| JP | 63-248379 | 10/1988 |
| JP | 8-332068 | 12/1996 |
| JP | 2017-529848 | 10/2017 |
| JP | 2017-530704 | 10/2017 |

OTHER PUBLICATIONS

PCT Search Report and Written Opinion for PCT/EP2018/084644 dated Mar. 4, 2019 (10 pages).
International Preliminary Report on Patentability for PCT/EP2018/084644 dated Mar. 30, 2020 (10 pages).
Office Action issued in Japan for Application No. 2020-535537 dated Jan. 18, 2023 (14 pages). English translation included.

* cited by examiner

METHOD FOR THE PREPARATION OF A SHEET INCLUDING A HOMOGENIZED MATERIAL CONTAINING ALKALOIDS AND AEROSOL FORMING ARTICLE COMPRISING A COMPONENT PREPARED FROM IT

This application is a U.S. National Stage Application of International Application No. PCT/EP2018/084644 filed Dec. 12, 2018, which was published in English on Jul. 4, 2019 as International Publication No. WO 2019/129493 A1. International Application No. PCT/EP2018/084644 claims priority to European Application No. 17211109.8 filed Dec. 29, 2017.

The present invention is related to a method for producing a sheet including a homogenized material containing alkaloids, such as homogenized tobacco material, and to an aerosol-forming article comprising a component prepared from it.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The starting material for the production of homogenized tobacco material for aerosol-generating article may also be mostly tobacco leaves that have thus the same size and physical properties as the tobacco for the blending of cut filler.

Possible forms of homogenized tobacco material include reconstituted tobacco sheet and cast leaf. The process to form homogenized tobacco material sheets commonly comprises a step in which ground tobacco and a binder are mixed to form a slurry. The slurry is then used to create a tobacco web or sheet, for example by casting a viscous slurry onto a moving metal belt to produce so called cast leaf. Alternatively, a slurry with low viscosity and high water content can be used to create reconstituted tobacco in a process that resembles paper-making.

The sheet or web of homogenized tobacco material is typically doctored from a moving metal belt and then rolled in bobbins, which need to be unwound in order to be further processed and included in as an aerosol-forming substrate in a aerosol-forming article.

It may be desired to improve or modify the process to form a sheet including a homogenized tobacco material in terms of its productivity.

Indeed, the sheet including a homogenized tobacco material may be difficult to handle and store due to its consistency, sensitivity to heat, stickiness or low tensile strength: it could easily be torn apart and, if too high force is used to handle the sheets, the same could break. For example, the sheet of homogenized tobacco material may be difficult to be removed from a moving metal belt where it is positioned or to unwind when coiled in bobbins.

Additionally, bobbins including sheets of homogenized tobacco materials may be also difficult to transport. Furthermore, they are preferably to be used within a very short timeframe, since otherwise the windings of the sheet of homogenized tobacco materials may bind together and may compromise unwinding. Consequently, building up a safety-stock of such bobbins can be a difficult task as well.

There is therefore a need for a method for producing a sheet of material containing alkaloids that is easily removed from a moving belt onto which it is transported. There is a need for a method for producing a sheet of material containing alkaloids that is easily unwound from a bobbin, and that therefore allows providing a continuous, constant and regular feed of material to a downstream apparatus so that the rest of the production line can increase the overall production rate, thus improving production.

The invention may satisfy at least one of the above needs.

In an aspect, the invention relates to a method for the preparation of a sheet including a homogenized material containing alkaloids, said method comprising: forming a mixture comprising particles of a material containing alkaloids and starch, and a quantity of a first additive comprising a component selected from the group consisting of water, aerosol-former and binder, wherein the quantity of the first additive is comprised between about 0.1 percent and about 50 percent by weight of the total weight of the mixture; applying to the mixture a mechanical energy of at least about 20 watt-hour per kilogram of the mixture; combining the mixture with a quantity of a second additive comprising a component selected from the group consisting of water, aerosol-former, and binder, to form a slurry; and forming a sheet from the slurry.

In another aspect, the invention relates to a method for the preparation of a sheet including a homogenized material containing alkaloids, said method comprising: forming a mixture comprising particles of a material containing alkaloids and starch, and a quantity of water comprised between about 0.1 percent and about 50 percent by weight of the total weight of the mixture; applying to the mixture a mechanical energy of at least about 20 watt-hour per kilogram of the mixture; combining the mixture with a quantity of a second additive comprising a component selected from the group consisting of water, aerosol-former, and binder, to form a slurry; and forming a sheet from the slurry.

In another aspect, the invention relates to a method for the preparation of a sheet including a homogenized material containing alkaloids, said method comprising: forming a mixture comprising particles of a material containing alkaloids and starch, and a first quantity of water comprised between about 0.1 percent and about 50 percent by weight of the total weight of the mixture; applying to the mixture a mechanical energy of at least about 20 watt-hour per kilogram of the mixture; forming a slurry combining the mixture with a second quantity of water comprised between about 55 percent and about 90 percent by weight of the total weight of the slurry; and forming a sheet from the slurry.

In the method of the invention, a mixture comprising particles of a material containing alkaloids and starch, and a quantity of a first additive comprising a component selected from the group consisting of water, aerosol-former and binder is formed. In this mixture, the quantity of the first additive is comprised between about 0.1 percent and about 50 percent in weight of the total weight of the mixture.

A mechanical energy of at least about 20 watt-hour per kilogram of the mixture is applied to this mixture. Without being bound by theory, in these conditions, the first additive may interact and may modify the starch contained in the material containing alkaloids so that the resulting mixture when combined with the second additive comprising a component selected from the group consisting of water, aerosol-former, and binder, to form a slurry may lead to a sheet showing improved characteristics with regards to consistency, sensitivity to heat, stickiness or tensile strength.

As used herein, the term "sheet" denotes a laminar element having a length and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters.

A "material containing alkaloids" is a material which contains one or more alkaloids. The alkaloids may comprise nicotine. The nicotine may be found, for example, in tobacco. The material containing alkaloids is preferably tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein "starch" is a part of the material containing alkaloids. It can also be added independently.

Starch is a polymeric carbohydrate consisting of a large number of glucose units joined by glycosidic bonds. Starch is produced by most green plants as energy storage. It is the most common carbohydrate in human diets and is contained in plants like potatoes, wheat, maize (corn), rice, and tobacco. It consists of two types of polymeric molecules: the linear and helical amylose and the branched amylopectin, which arrange themselves in the plant in semi-crystalline granules. As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behavior.

As used herein, the term "homogenized tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco sheet. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition may then be casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material may be then rolled in bobbins which needs to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. Tobacco, together with other compounds, may be classed as an aerosol forming material, particularly a sheet of homogenized tobacco comprising an aerosol former. An aerosol forming substrate may comprise or consist of an aerosol forming material.

The properties of the homogenized tobacco material may influence the process to form a sheet including the latter.

Indeed, generally the homogenized tobacco material is "sticky", that is, it glues to adjacent objects, and at the same time is rather fragile with a relatively low tensile strength. Without being bound by theory, it is believed that such properties may be due to the presence of a binder and an aerosol-former, such as guar and glycerin, in the homogenized tobacco material.

According to the method of the invention, a sheet of material containing alkaloids is produced.

A mixture of particles of a material containing alkaloids and starch and a quantity of a first additive comprising a component selected from the group consisting of water, aerosol-former and binder is formed.

In this mixture, the quantity of the first additive is comprised between about 0.1 percent and about 50 percent by weight of the total weight of the mixture. The weight of the first additive represents between 0.1 and 50 percent of the total weight of the mixture.

Preferably, the ratio in weight (that is, the ratio between the first additive weight and the weight of the starch in the mixture) between the amount of the first additive and the amount of starch of the material containing alkaloids in the mixture is comprised between about 2 and about 80.

Preferably, the amount of the first additive is comprised between about 5 percent and about 40 percent by weight of the total weight of the mixture, more preferably between about 10 percent and 30 percent.

The mixture may contain more than one first additive from the above mentioned group. Preferably, the particles and the first additive are mixed by any know tool.

Preferably, the first additive is water. The amount of water in the mixture by weight of the total weight of the mixture is preferably comprised between about 5 percent and about 30 percent, more preferably between about 10 percent and about 20 percent, even more preferably between about 10 percent and about 18 percent.

To this mixture is then applied a mechanical energy of at least about 20 watt-hour per kilogram of the mixture.

The energy is applied by any know means, for example, by stirring, mixing, or others.

In these conditions, the first additive interacts and possibly modifies the starch contained in the material containing alkaloids. Without willing to be bound to any specific theory, the first additive may interact with the amylose and amylopectin polymers of the starch and may modify its crystalline and granular structure.

In this way, the starch modifies the characteristics of the resulting mixture that is then combined with a second additive comprising a component selected from the group consisting of water, aerosol-former, and binder, to form a slurry. A sheet is then formed from the slurry, sheet which possibly shows characteristics of consistency, sensitivity to heat, stickiness or tensile strength which are optimal to be used as a component in an aerosol generating article. In particular, the sheet may have an improved tensile strength, or a better heat resistance, or a lower stickiness or a better consistency when compared to a sheet formed by the same slurry but where the starch component of the material containing alkaloids has not interacted under the specific conditions of applied mechanical energy with the specific quantity of the first additive prior to the sheet's formation.

Preferably, the second additive is added after the mechanical energy is applied to the mixture.

Preferably, forming a slurry includes combining the mixture with a quantity of water comprised between about 55 percent and about 90 percent by weight of the total weight of the slurry. Water can be the second additive or it can be added together with a further second additive.

Preferably, the step of forming a slurry includes mixing the second additive with the mixture.

Further, the sheet may show better surface properties, such as a smoother surface with less defects when compared to a sheet formed by the same slurry but where the material containing alkaloids has not interacted under the specific conditions of applied mechanical energy with the specific quantity of the first additive prior to the sheet's formation.

Further, the same slurry may show optimal properties relating to its viscosity and density, which may also remain stable in time.

Preferably, the particles of the material containing alkaloids have a mean size comprised between about 0.02 millimetres and about 0.3 millimetres. More preferably, the mean size is comprised between about 0.05 millimetres and about 0.2 millimetres.

The mean size of between about 0.02 millimetres and about 0.3 millimetres represents the size at which the tobacco cells may be at least in part destroyed. The use of a material containing alkaloids having such a mean size advantageously leads to a smooth and uniform slurry in the downstream processing steps of the material containing alkaloids.

Preferably, the first additive comprises water.

Preferably, the first additive comprises a binder.

The binder used as the first additive may be any of gums or pectins described herein below. For a descriptive review of gums which can be used as a binder, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivatized starches; celluloses, such as methyl, ethyl, ethylhydroxymethyl and carboxymethyl cellulose; tamarind gum; dextran; pullalon; konjac flour; xanthan gum and the like. The particularly preferred binder for use in the first additive is guar.

Preferably, the first additive comprises an aerosol-former.

Suitable aerosol-formers as the first additive are known in the art and include, but are not limited to: monohydric alcohols like menthol, polyhydric alcohols, such as triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerin and propylene glycol.

Preferably, the step of forming a mixture includes adding a reducing sugar in an amount comprised between about 2 percent and about 30 percent per weight on dry weight basis of the mixture, more preferably, between about 5 percent and about 25 percent per weight on dry weight basis of the mixture, more preferably between about 10 percent and about 15 percent per weight on dry weight basis of the mixture, and even more preferably between about 11 percent and about 14 percent per weight on dry weight basis of the mixture.

The reducing sugar may modify the material containing alkaloids when the mechanical energy is applied on the mixture, so that the resulting material has different characteristics compared to the material containing alkaloids to which the reducing sugar has not been added, in terms of composition of the material containing alkaloids. These differences affect the final characteristics of the sheet.

A reaction between the reducing sugar and the material containing alkaloids, particularly if ammonia and ammonium containing compounds are contained in the latter, possibly occurs. This reaction modifies the composition of the material containing alkaloids, so that the resulting material has a lower quantity of ammonia or ammonium containing compounds compared to the material containing alkaloids to which the reducing sugar has not been added so that the aerosol generated from said material may therefore show desired or different characteristics, for example in terms of flavor.

This amount of reducing sugar has proven to be optimal to obtain the desired characteristics in the final product. For example, a desired level of ammonia may be obtained.

Preferably, the reducing sugar is selected from glucose, fructose, xylose, ribose, galactose, and mixtures thereof. More preferably, the reducing sugar is glucose, fructose and mixtures thereof.

Preferably, the reducing sugar is mixed with the material containing alkaloids in powder form, in liquid form or in slurry form.

The material containing alkaloids can be in any desired form before mixing with the reducing sugars.

Preferably, the quantity of the first additive is comprised between about 10 percent and about 70 percent per weight on dry weight basis of the starch component of the material containing alkaloids, more preferably between about 20 percent and about 60 percent per weight on dry weight basis of the starch component of the material containing alkaloids, even more preferably between about 30 percent and about 50 percent per weight on dry weight basis of the starch component of the material containing alkaloids.

Preferably, a mechanical energy of at least about 50 watt-hour per kilogram of the mixture is applied to the mixture, more preferably of at least about 100 watt-hour per kilogram of the mixture, more preferably of at least about 150 watt-hour per kilogram of the mixture, more preferably comprised between about 150 watt-hour per kilogram of the mixture and about 350 watt-hour per kilogram of the mixture, more preferably between about 200 watt-hour per kilogram of the mixture and about 300 watt-hour per kilogram of the mixture, and even more preferably between about 225 watt-hour per kilogram of the mixture and about 275 watt-hour per kilogram of the mixture.

Preferably, the applied mechanical energy is lower than about 350 watt-hour per kilogram of the mixture to avoid or to minimize nicotine loss.

Preferably, the step of applying to the mixture a mechanical energy comprises: extruding the mixture.

Extrusion is a process used to create objects pushing a material, in this case the above mentioned mixture, through a die of a desired cross-section. The mixture in the die encounters compressive and shear stresses. The mixture therefore is pushed from an input to an output of an extruder while substantially absorbing energy.

Extrusion is a preferred way of applying mechanical energy to the mixture and may contribute to improve the interaction of the first additive with the starch component of the material containing alkaloids.

Preferably, the step of applying mechanical energy is performed at a temperature lower than or equal to about 190 Celsius degrees, more preferably between about 30 Celsius degrees and about 190 Celsius degrees. More preferably, the maximum temperature reached during the step of applying energy is between about 140 Celsius degrees and about 190 Celsius degrees, even more preferably between about 175 Celsius degrees and about 185 Celsius degrees.

The extrusion temperature may influence the interaction between the first additive and the starch contained in the material containing alkaloids. This extrusion temperature in the extruder has proven to be optimal to obtain an interaction between the first additive and the starch contained in the material containing alkaloids.

Other processing conditions, such as the extrusion time of the extrusion, may also be relevant factors, since it may also influence the interaction between the first additive and the starch of the material containing alkaloids.

Preferably, the step of applying mechanical energy is performed for an application time comprised between about 10 seconds and about 80 seconds, more preferably between about 10 seconds and about 60 seconds, more preferably between about 15 seconds and about 50 seconds, more preferably between about 20 seconds and about 30 seconds and even more preferably between about 22 seconds and about 27 seconds.

In the method of the invention, the second additive may be the same or different from the first additive.

Preferably, the second additive comprises water.

Preferably, the second additive comprises a binder. Preferably, the binder used in the second additive may be any of the gums or pectins described above with regard to the first additive. The particularly preferred binder for use in the second additive is guar.

Preferably, the second additive comprises an aerosol-former. Preferably, the aerosol-former used in the second additive may be any of the aerosol-formers described above with regard to the first additive. Examples of preferred aerosol-formers in the second additive are glycerin and propylene glycol.

Preferably, the quantity of the second additive is comprised between about 200 percent and about 550 percent per weight on dry weight basis of the slurry, more preferably between about 200 percent and about 500 percent per weight on dry weight basis of the slurry.

Preferably, the slurry comprises from about 45 percent to about 93 percent in dry weight basis of the particles of the material containing alkaloids. More preferably, the slurry comprises from about 65 percent to about 83 percent in dry weight basis of the particles of the material containing alkaloids.

Preferably, the slurry comprises from about 1 percent to about 10 percent in dry weight basis of the binder. More preferably, the slurry comprises from about 4 percent to about 8 percent in dry weight basis of the binder.

Preferably, the slurry comprises from about 5 percent to about 30 percent in dry weight basis of the aerosol-former. More preferably, the slurry comprises from about 15 percent to about 25 percent in dry weight basis of the aerosol-former.

Preferably, the slurry comprises from about 150 percent and about 500 percent in dry weight basis of water.

Preferably, the slurry has a water content of between about 10 percent and about 90 percent per weight, more preferably between about 20 percent and about 80 percent per weight, even more preferably between about 40 percent and about 80 percent per weight, even more preferably between about 60 percent and about 80 percent before the step of forming the sheet.

Preferably, in the method of the invention the step of forming a slurry comprises: homogenizing the slurry.

Preferably, in the method of the invention the step of homogenizing the slurry is performed at a temperature between about 20 Celsius degrees and about 60 Celsius degrees, more preferably between about 25 Celsius degrees and about 55 Celsius degrees.

Preferably, the method of the invention comprises adding cellulose fibres to the material containing alkaloids.

Cellulose fibres may be introduced in the slurry. The introduction of cellulose fibres in the slurry typically increases the tensile strength of the material containing alkaloids, acting as a strengthening agent.

Therefore, adding cellulose fibres may increase the resilience of the material containing alkaloids.

Cellulose fibres for adding to a material containing alkaloids such as homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

The length of cellulose fibres is advantageously between about 0.2 millimetres and about 4 millimetres. Preferably, the mean length per weight of the cellulose fibres is between about 1 millimetre and about 3 millimetres.

Further, preferably, the amount of the cellulose fibres added to the material containing alkaloids in addition to the cellulose fibres already present in the latter is comprised between about 1 percent and about 7 percent in dry weight basis of the total weight of the slurry.

Preferably, the method of the invention comprises the step of adding a further material containing alkaloids to the slurry.

Preferably, the step of forming a sheet from the slurry comprises: casting the slurry into the sheet.

Preferably, the method of the invention comprises the step of drying the sheet including the homogenized material containing alkaloids.

Preferably, the sheet including the homogenized material containing alkaloids has a water content of between about 7 percent and about 15 percent per weight after the drying.

Preferably, the sheet including the homogenized material containing alkaloids comprises between about 45 percent and about 93 percent in dry weight basis of material containing alkaloids.

Preferably, the material containing alkaloids is a homogenized tobacco material. In such a case, the alkaloids contained in the material may comprise nicotine.

According to a second aspect, the invention relates to an aerosol forming article comprising a component prepared from the method according to the first aspect of the invention.

The advantages of the second aspect have been already outlined with reference to the first aspect and are not repeated herewith.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material without combustion or heating.

Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenishable or replaceable aerosol forming substrate.

An aerosol forming article may also include a combustible cigarette. In preferred embodiments, the aerosol forming-article may be substantially cylindrical in shape. The aerosol forming article may be substantially elongated. The aerosol forming article may have a length and a circumference substantially perpendicular to the length. The aerosol forming article may have a total length between approximately about 30 millimeters and approximately about 100 millimeters. The aerosol forming article may have an external diameter between approximately about 5 millimeters and approximately about 12 millimeters.

In all the aspects of the invention, preferably, the material containing alkaloids is a homogenized tobacco material. In such a case, the alkaloids contained in the material may comprise nicotine.

The homogenized tobacco sheet includes tobacco particles grinded from tobacco leaves (for example tobacco stem and lamina).

The homogenized tobacco sheet may also comprise a minor quantity of one or more of tobacco dust, tobacco fines, and other particulate tobacco by-products formed during the treating, handling and shipping of tobacco.

The tobacco present in the homogenized tobacco material may constitute the majority of the tobacco, or even substantially the total amount of tobacco present in the aerosol-generating article.

Specific embodiments of the invention will be further described, by way of example only, with reference to the accompanying drawings in which.

Figure 1:
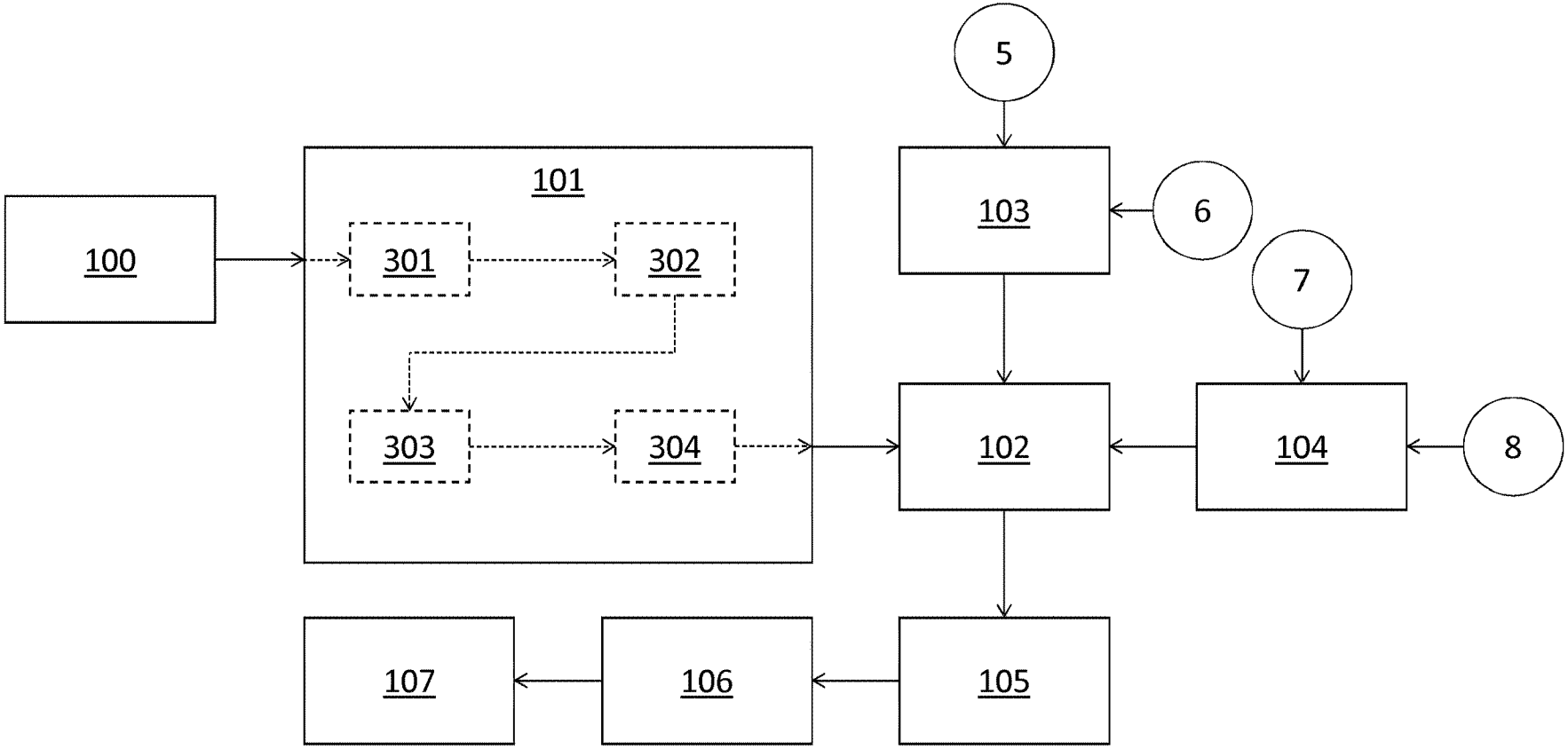
FIG. 1 shows a flow diagram of a method for production of a sheet including a homogenized tobacco material according to the invention.

With initial reference to FIG. 1, a method to produce a sheet of a homogenized material containing alkaloids according to the invention is represented.

In a first step 100, a mixture of particles of a material containing alkaloids, a reducing sugar and a first additive is formed. The material containing alkaloids is a tobacco material containing the alkaloid nicotine. Further, tobacco contains starch. The reducing sugar is fructose. The first additive is water.

Preferably the mixture includes (percent in weight of the total mixture):

64-82% tobacco powder;

8-18% of added sugar;

10-18% of added water.

Figure 2:
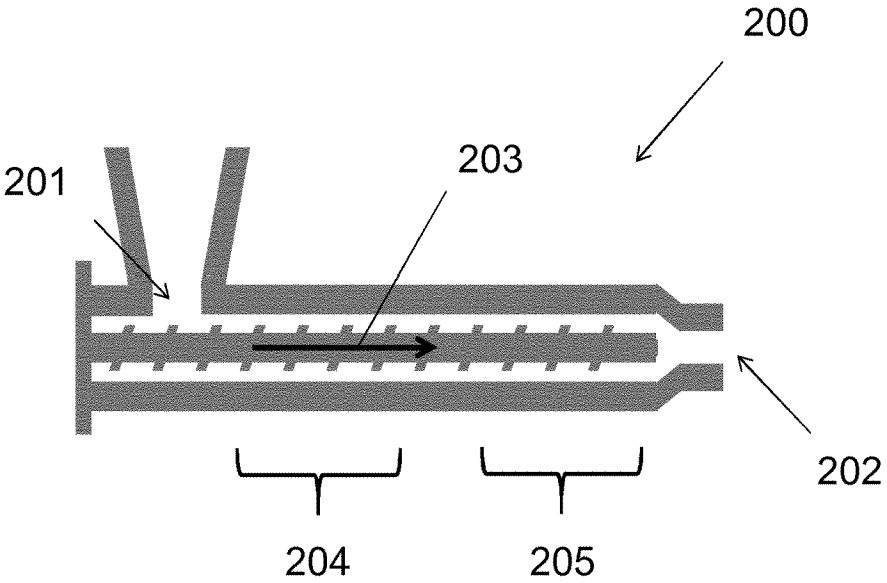
FIG. 2 shows a schematic lateral view of an extruder used to produce an extruded mixture.

The method includes a further step 101 in which the mixture is receiving energy, such as for example in an extruder 200 (represented in FIG. 2) including an inlet 201 and an outlet 202. In the extruder 200, the mixture moves along a direction of extrusion defined between the inlet 201 and the outlet 202 indicated in FIG. 2 by arrow 203 and is subjected to a thermo-mechanical treatment.

Preferably, a mechanical energy between about 180 and about 435 watt-hour per kilogram of the mixture is applied. More preferably, the mechanical energy is between about 225 watt-hour per kilogram of the mixture and about 275 watt-hour per kilogram of the mixture.

During the energy application, for example in the extruder, the reducing sugar preferably undergoes to a reaction with the ammonia and the ammonium containing compounds of the tobacco material. Further, also the starch present in the tobacco undergoes a reaction with water.

Figure 3:
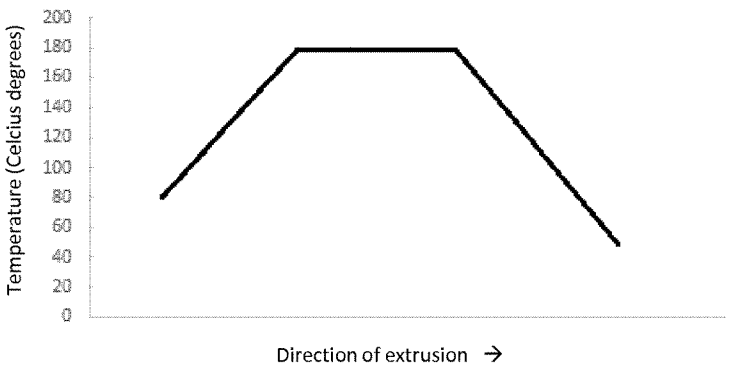
FIG. 3 shows a thermal profile of an extruder used of an extruder used to produce an extruded mixture.

In FIG. 3 is shown a schematic thermal profile along the direction of extrusion 203 of an extrusion process of the method of the invention. Extrusion is a possible example of energy application.

Step 101 of FIG. 1 includes a sub-step 301 in which the mixture is fed to extruder 200.

After sub-step 301, step 101 includes a further sub-step 302 of heating the mixture present inside the extruder 200 to a first temperature lower than or equal to about 190 Celsius degrees. Preferably, the first temperature is between about 90 Celsius degrees and about 190 Celsius degrees, more preferably between about 140 Celsius degrees and about 190 Celsius degrees, even more preferably between about 175 Celsius degrees and about 185 Celsius degrees. Preferably, heating is carried out in a first part 204 of the extruder 200. Preferably, the residence time in the first part of the extruder is between about 18 seconds and about 22 seconds.

After the sub-step 302 of heating the mixture to a first temperature, a further sub-step 303 of cooling the mixture present inside the extruder 200 from the first temperature to a second temperature lower than or equal to about 70 Celsius degrees is preferably performed. Preferably, the second temperature is between about 30 Celsius degrees and about 70 Celsius degrees, more preferably between about 35 Celsius degrees and about 50 Celsius degrees, even more preferably between about 35 Celsius degrees and about 45 Celsius degrees. Preferably, cooling is carried out in a second part 205 of the extruder 200, downstream to the first part 204 of the extruder 200 in the direction of extrusion 203. Preferably, the residence time in the second part 205 of the extruder is between about 18 seconds and about 22 seconds.

As shown in FIG. 3, the extrusion step 101 may include keeping the mixture at the first temperature, preferably within the first part 204 of the extruder 200, for a certain residence time before the step of cooling the mixture. Preferably, this residence time is comprised between about 6 seconds and about 40 seconds. More preferably this residence time is between about 7 seconds and about 11 seconds.

After the sub-step 303 of cooling the mixture from the first temperature to a second temperature, a further step 304 of discharging the mixture at the second temperature from the extruder 200 is performed. In this way, a tobacco mixture having a lower quantity of ammonia and ammonium containing compounds compared to the tobacco material before the extrusion process. Further, the starch may have reacted with water.

The extruded mixture has preferably these characteristics: the tobacco powder remain the same, however the slurry contains (percent in weight)

5-8% of water 2-6% sugar (they have reacted with ammonia).

After extrusion step 101, the extruded mixture is used in a subsequent slurry preparation step 102.

Prior to or during the slurry preparation step 102, the method of the invention may include two further steps: a pulp preparation step 103 where cellulose fibres 5 and water 6 are pulped to uniformly disperse and refine the fibres in water, and a suspension preparation step 104, where an aerosol-former 7 and a binder 8 are premixed. Preferably, the aerosol-former 7 includes glycerol and the binder 8 includes guar. Advantageously, the suspension preparation step 104 includes premixing guar and glycerol without the introduction of water.

The slurry preparation step 102 preferably comprises transferring the premix solution of the aerosol-former and the binder to a slurry mixing tank and transferring the pulp to the slurry mixing tank. Further, the slurry preparation step comprises dosing the extruded tobacco powder exiting from the extruder into the slurry mixing tank with pulp, and the guar-glycerol suspension. Additional tobacco powder may be added as well. More preferably, this step also includes processing the slurry with a high shear mixer to ensure uniformity and homogeneity of the slurry.

Preferably, the slurry preparation step 102 also includes a step of water addition, where water is added to the slurry to obtain the desired viscosity and water content.

Preferably, the composition of the slurry is as follow:

The mixture going out of the extruder is mixed with cellulose fibers. The obtained mixture is mixed with (premixed guar gum glycerin) and water to obtain the following slurry (percent in weight):

15-30% of the tobacco mixture out of the extrusion process;

65-75% water;

0.5-1.5% added cellulose fibres;

0.1-1% guar gum;

2-7% glycerine.

In order to form the sheet including the homogenized tobacco material, preferably the slurry formed according to step 102 is cast in a casting step 105. Preferably, this casting step 105 includes transporting the slurry to a casting station and casting the slurry into sheet having a homogenous and uniform thickness on a support. Preferably, during casting, the cast sheet thickness, water content and density are controlled immediately after casting and more preferably are also continuously monitored and feedback-controlled using slurry measuring devices during the whole process.

The homogenized cast sheet is then dried in a drying step 106 comprising a uniform and gentle drying of the cast sheet, for example in an endless, stainless steel belt dryer. The endless, stainless steel belt dryer may comprise individually controllable zones. Preferably the drying step comprises monitoring the cast sheet temperature at each drying zone to ensure a gentle drying profile at each drying zone and heating the support where the homogenized cast web is formed. Preferably, the drying profile is a so called TLC drying profile.

At the conclusion of the web drying step 106, a monitoring step (not shown) is executed to measure the moisture content and number of defects present in the dried web.

The sheet including the homogenized tobacco that has been dried to a target water content is then withdrawn from the moving steel belt and preferably wound up in a winding step 107, for example to form a single master bobbin. Due to the improved characteristics of the sheet including the homogenized tobacco according to the invention, the same is easily doctored or then unwound from the master bobbin without significant breakage of the sheet, thus increasing the productivity of the overall process. This master bobbin may be then easily used to perform the production of smaller bobbins by slitting and small bobbin forming process. The smaller bobbin may then be used for the production of an aerosol-generating article (not shown).

The invention claimed is:

1. Method for the preparation of a sheet including a homogenized material containing alkaloids, said method comprising:

forming a mixture comprising particles of a material containing alkaloids and starch, and a quantity of a first additive comprising a component selected from the group consisting of water, aerosol-former and binder, wherein the quantity of the first additive is comprised between about 0.1 percent and about 50 percent by weight of the total weight of the mixture;

applying to the mixture a mechanical energy of at least about 20 watt-hour per kilogram of the mixture;

combining the mixture with a quantity of a second additive comprising a component selected from the group consisting of water, aerosol-former, and binder, to form a slurry, comprising:

combining the mixture with a quantity of water comprised between about 55 percent and about 90 percent by weight of the total weight of the slurry; and forming a sheet from the slurry.

2. Method according to claim 1, wherein the second additive is added after the mechanical energy has been applied to the mixture.

3. Method according to claim 1, wherein the particles of the material containing alkaloids have a mean size comprised between about 0.02 millimetres and about 0.3 millimetres.

4. Method according to claim 1, wherein the step of forming a mixture includes adding a reducing sugar in an amount comprised between about 2 percent and about 30 percent per weight on dry weight basis of the mixture.

5. Method according to claim 1, wherein the step of applying to the mixture a mechanical energy comprises:

extruding the mixture.

6. Method according to claim 1, wherein the step of applying to the mixture a mechanical energy of at least about 20 watt-hour per kilogram of the mixture is performed at a temperature lower than or equal to about 190 Celsius degrees.

7. Method according to claim 1, wherein the step of applying to the mixture a mechanical energy of at least about 20 watt-hour per kilogram of the mixture is performed for an application time between about 10 seconds and about 80 seconds.

8. Method according to claim 1, wherein the step of combining the mixture with a quantity of a second additive comprising a component selected from the group consisting of water, aerosol-former, and binder, to form a slurry includes adding a quantity of the second additive comprised between about 150 percent and about 600 percent per weight on dry weight basis of the slurry.

9. Method according to claim 1, wherein the step of combining the mixture with a quantity of a second additive comprising a component selected from the group consisting of water, aerosol-former, and binder, to form a slurry is such that the slurry comprises from about 45 percent to about 93 percent in dry weight basis of the particles of the material containing alkaloids.

10. Method according to claim 1, wherein the step of combining the mixture with a quantity of a second additive comprising a component selected from the group consisting of water, aerosol-former, and binder, to form a slurry is such that the slurry comprises from about 1 percent to about 10 percent in dry weight basis of the binder.

11. Method according to claim 1, wherein the step of combining the mixture with a quantity of a second additive comprising a component selected from the group consisting of water, aerosol-former, and binder, to form a slurry is such that the slurry comprises from about 5 percent to about 30 percent in dry weight basis of the aerosol-former.

12. Method according to claim 1, wherein the step of combining the mixture with a quantity of a second additive comprising a component selected from the group consisting of water, aerosol-former, and binder, to form a slurry is such that the slurry comprises from about 150 percent and about 500 percent in dry weight basis of water.

13. Method according to claim 1, comprising:

adding cellulose fibres to the material containing alkaloids.

14. Method according to claim 1, wherein the material containing alkaloids is a tobacco material.

15. Method according to claim 1, comprising the step of drying the sheet including the homogenized material containing alkaloids.

* * * * *